US009550377B2

(12) United States Patent
Ortiz et al.

(10) Patent No.: US 9,550,377 B2
(45) Date of Patent: Jan. 24, 2017

(54) SYSTEM AND METHOD TO MITIGATE MEDIA ROLL CURL

(71) Applicant: HEWLETT-PACKARD DEVELOPMENT COMPANY, L.P., Houston, TX (US)

(72) Inventors: Hugo S. Ortiz, Vancouver, WA (US); Bruce G. Johnson, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 14/836,463

(22) Filed: Aug. 26, 2015

(65) Prior Publication Data

US 2015/0360482 A1 Dec. 17, 2015

Related U.S. Application Data

(62) Division of application No. 13/755,428, filed on Jan. 31, 2013.

(51) Int. Cl.

| | |
|---|---|
| ***B41J 2/165*** | (2006.01) |
| ***B41J 11/00*** | (2006.01) |
| ***B41J 11/42*** | (2006.01) |

(52) U.S. Cl.

CPC ..... *B41J 11/0045* (2013.01); *B41J 11/0005* (2013.01); *B41J 11/0095* (2013.01); *B41J 11/42* (2013.01)

(58) Field of Classification Search

None

See application file for complete search history.

(56) References Cited

U.S. PATENT DOCUMENTS

| | | | | |
|---|---|---|---|---|
| 4,977,432 | A | 12/1990 | Coombs et al. | |
| 5,848,347 | A | 12/1998 | Kuo et al. | |
| 6,183,152 | B1 | 2/2001 | Kumai et al. | |
| 6,293,670 | B1 * | 9/2001 | Taniguro | B41J 11/005 347/104 |
| 7,618,204 | B2 | 11/2009 | Blanchard et al. | |
| 2003/0103132 | A1 | 6/2003 | Oshima et al. | |
| 2004/0119807 | A1 * | 6/2004 | Fujiwara | B41J 11/0005 347/218 |
| 2004/0212649 | A1 | 10/2004 | Ouchi | |
| 2007/0064032 | A1 * | 3/2007 | Kawabata | B41J 3/60 347/9 |
| 2012/0004087 | A1 | 1/2012 | Tharayil et al. | |

OTHER PUBLICATIONS

Wyatt, A., Reducing the Curl in Printed Documents, (Web Page), Jul. 21, 2012.

* cited by examiner

*Primary Examiner* — Alejandro Valencia
(74) *Attorney, Agent, or Firm* — HP Inc. Patent Department

(57) ABSTRACT

A method includes advancing, by a controller device comprising a processing resource, a media from a roll into a printer via rollers before a printing process begins, wherein a leading edge of the media comprises a curl due to the roll. The method also includes guiding, by the controller device, the media through the printer to engage a substrate in a predetermined zone spaced downstream a predetermined distance from a roller pinch point. The method also includes holding, by the controller device, the media against the substrate in the predetermined zone to force the leading edge of the media to bend in a direction opposite the curl of the leading edge to counteract the curl of the leading edge.

12 Claims, 5 Drawing Sheets

SYSTEM AND METHOD TO MITIGATE MEDIA ROLL CURL

RELATED APPLICATIONS

This application is a divisional co-pending U.S. application Ser. No. 13/755,428, filed Jan. 31, 2013, and entitled "SYSTEM AND METHOD TO MITIGATE MEDIA ROLL CURL," which is incorporated herein by reference in its entirety for all purposes.

BACKGROUND

Printers utilize many components to control how media such as paper is guided though the printers during a printing process. Such printing components can include a feed system having rollers to initially guide the media toward a print zone where a print head applies ink on to the media, or where an image is transferred to the media. As the media is fed through the printer and after printing, an output also having rollers can direct the media outside of the printer.

One of the challenges faced when printing on media that has been stored on a roll is from curl that is set in the media as a result of the roll. This curl is due to the media being stored and wound around a small diameter core for an extended period of time such as during shipping and storage before it is delivered to the end user. When the media is unwound off the core for printing, the media can be curled and in some cases can cause image defects such as smearing.

DETAILED DESCRIPTION

Systems and methods are provided to mitigate curl in media. Media, such as paper, can be wound on a spool to provide a roll of the media. As the media is fed off the spool for printing, a deformation in the leading edge of the media can occur where curl in the media has been formed from being wound on a spool. Prior systems attempted to add expensive de-curling equipment to the printer to reduce the media curl. The systems and methods described herein do not require such expensive equipment, but rather utilize control techniques and existing printer structure to mitigate the roll curl in the media.

As an example, the system includes a controller to adjust the speed and feed direction in which media is guided through a printer. The controller can include a park control module to command the controller to guide a leading edge of the media to engage a substrate in a park zone in the printer. The park zone can include a contact surface of a platen in the printer that is spaced a predetermined distance from a roller pinch point in the printer where the leading edge of the media is to engage the platen to mitigate roll curl in the media. The park zone can be located on the contact surface of the platen such that engagement between the leading edge and such surface can mitigate the roll curl in the media. For example, the roll curl can be mitigated by creating a reverse bow in the media which counteracts the curl from the leading edge of the media as it is spooled. As a further example, the park zone of the leading edge can be located at a predetermined distance from a roller pinch point in the printer where the leading edge of the media engages a surface of a platen in the printer to create the reverse-bow effect on the media and thereby mitigate roll curl in the media.

Figure 1:
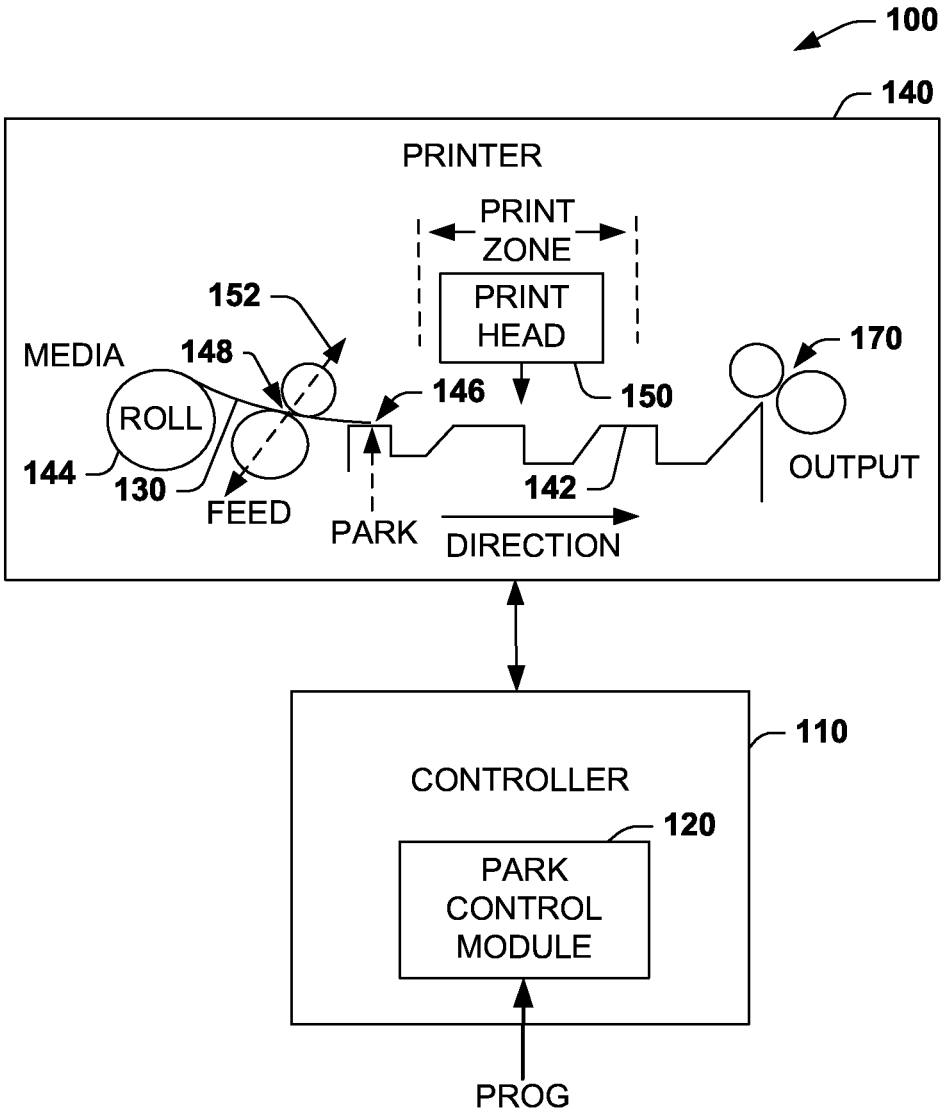
FIG. 1 illustrates an example system that utilizes a controller and park control module to mitigate roll curl in media before printing begins.

FIG. 1 illustrates an example system 100 that includes a controller 110 and park control module 120 to mitigate roll curl in media 130. The controller 110 can adjust the speed and feed direction in which the media 130 is guided through a printer 140. The park control module 120 can command the controller 110 to move the media 130 during a printing process to a location where it is flexed opposite the direction of the curl and held (or slowed) for a predetermined time, to mitigate curl in the media. As shown in the example of FIG. 1, an arrow indicates a park zone on a platen 142 in the printer 140 to where the media can be guided and held during the printing process. For example, the media 130 can be guided slightly past the park zone, reversed to the park zone, and then held for a predetermined time on the platen 142 to mitigate roll curl. In one example, a time for holding the media at the park zone can be a physical stop in the advance of the media 130 (e.g., hold for several seconds). In another example, the hold time could be implemented as a reduction in speed as the media 130 approaches the park zone and advances past the zone while readying to be printed. Such reduction in speed, while not providing an actual physical stop could provide sufficient time to emulate the effects of the physical stop, such as if the reduction in speed resulted in arriving at the print zone in substantially the same time as a predetermined hold time at a stationary position. Thus, as used herein slowly moving the media 130 across the platen 142 can correspond to holding the media at a stationary position on the media to mitigate curl.

Curl refers to a bend or bow in the media 130 that typically occurs after the media 130 has been wound on a roll 144. Such curl can be mitigated by moving the media 130 to a location in the printer 140 on the platen 142 where the media 130 is forced to bend in the opposite direction to the curl create a reverse-bow effect from the curl as it comes off the roll 144.

As a further example, the park control module 120 can be programmed to command the controller 110 to guide a leading edge 146 of the media 130 to the park zone in the printer 140. The park zone for the leading edge 146 can be spaced a predetermined distance from a roller pinch point 148 (also referred to as the feed 148) along a direction of media travel in the printer 140. The park zone can refer to a position (or positions) where the leading edge of the media 130 engages a surface of a platen 142 in the printer as to mitigate roll curl in the media. Although the controller 110 and park control module 120 are shown as separate components from the printer 140, such components can be integrated inside the printer, for example. Also, the park control module 120 can be implemented as computer-readable instructions that can be executed by a processing resource (e.g., one or more processing cores) inside the controller 110, for example. A program input to the park control module enables adjustable settings to be applied to the module. Such settings can control media speed, media direction, park zone locations, hold times, and so forth, for example.

In the example, of FIG. 1, the printer includes a print head 150 to transfer an electronic representation of information to the media 130 when the media enters a zone in the printer 140 referred to as the print zone. In some examples, the print head 150 can be implemented as including a jet transfer to apply ink onto the media 130 when the media resides in the print zone. As shown, the feed at 148 and an output 170 can be employed to control the position and speed of the media 130 while in, entering, or exiting the printer 140. The feed 148 and output 170 can include an arrangement of rollers to guide the media 130 along a media path. Rollers that pinch the media between them can be positioned relative to each other at an angle referred to as the pinch angle, and a pinch point can be at positions up or down, right or left. A virtual plane, demonstrated as arrow 152, extending through axes of the rollers that form a pinch point, creates a pinch angle relative to the plane of the media. The amount of force (e.g., pinch) applied by the rollers at the feed 148, can be adjusted at an angle in the direction of the arrow 152. The output 170 can similarly have rollers adjusted with an independent pinch angle.

As a further example, the rollers can be positioned relative to each other to set to a pinch angle for the feed 148 and/or the output 170 between about 4 degrees and about 15 degrees. Other pinch angle settings are possible. It has been found that a pinch angle of about 12 degrees can create a suitable reverse bow on the media as it is held at a park position spaced the predetermined distance from the pinch point 148 and on the platen 142. When the media 130 is held between pinch rollers at 148 and extends into the print zone, resting on one of the platen ribs 142, it can be flexed such that the top surface is concave. This flexure is generally opposite to the flexure caused by curling of rolled media 130 and can be referred to as reverse bow. A portion of the media 130 that is curled can also be held near the feed 148 for a predetermined time delay period, either by stopping it or by feeding it through more slowly, and allowing the media to dwell in this location to mitigate the curl in the media and reduce further curl growth. Also, the park control module 120 can advance and reverse the direction of the media 130 over multiple cycles to further reduce curl in the media. In yet another example, the park control module 120 can cause the controller 110 to move the media to one zone on the platen and hold it at such position for a predetermined time, then move the leading edge to another zone and hold for a predetermined time, and so forth. Such a process can be repeated two or more times, for example, to mitigate media curl.

Typically, the media 130 is held in a reverse flexure region which is typically near the roller pinch point about where the platen 142 begins and illustrated at the example park location indicated by the park arrow. This position can be held in the reverse flexure region at location 146 for a period of time (seconds). The number of seconds the position is held can vary depending on the media type (e.g., paper, synthetic, plastic, polymer, vellum, and so forth) and what the environmental conditions (e.g., temperature, humidity, barometric pressure) are, for example. For example, the controller 110 can be provided sensor data representing one or more environmental conditions that can be used to adjust the holding time at the park position. Holding the position in the reverse bow region can be achieved either by stopping the curled media in that park location, or by passing it through a region, which includes the park position, at a slow speed selected to provide a suitable residence time in the reverse bow region. The speed and feed direction can be monitored by an encoder (not shown) to provide feedback to the controller 110. The media 130 is typically paper but can be a synthetic material (e.g., plastic), or a mixture of the paper and the synthetic material, for example.

As noted above, the park zone can be located at a predetermined distance from the roller pinch point 148 in the printer 140 where the leading edge 146 of the media engages a surface of a platen 142 in the printer to mitigate roll curl in the media. The leading edge 146 of the media 130 can be detected via a photo detector in one example but other detection methods are possible (e.g., sensor array). The park control module 120 can command the controller 110 to hold the leading edge 146 of the media 130 on a sloped surface of the platen at the predetermined distance from the roller pinch point 148 and for a predetermined period of time to mitigate roll curl in the media. In another example, the park control module 120 can command the controller 110 to hold the leading edge 146 of the media 130 on a flat surface of the platen 142 at the predetermined distance from the roller pinch point 148 and for a predetermined period of time to mitigate roll curl in the media. As one example, the predetermined distance can be set at a distance of about 12 millimeters from the roller pinch point 148 to the surface of the platen 142, and the roller pinch point 148 in the printer 140 can be set at an angle of about 12 degrees between rollers to mitigate roll curl in the media.

As a further example, configuration options to adjust the park control module 120 can also be implemented. For example, the park control module 120 can receive an adjustable control setting (e.g., via local user setting or remote network setting over the Internet) to control an amount of time the leading edge of the media 130 is held at the park position. As noted above, in another control example, the park control module 120 can command the controller 110 to reduce the speed of travel (e.g., reduced below normal speeds for printing and media advance) of the leading edge 146 of the media 130 over the platen 142 to emulate a stationary park position and mitigate roll curl in the media.

For purposes of simplification of explanation, in the present example, different components of the systems described herein are illustrated and described as performing different functions. However, one of ordinary skill in the art will understand and appreciate that the functions of the described components can be performed by different components, and the functionality of several components can be combined and executed on a single component or be further distributed across more components. The components can be implemented, for example, as an integrated circuit or as discrete components, or as a combination of both. In other examples, the components could be distributed among different printed circuit boards, for example.

Figure 2:
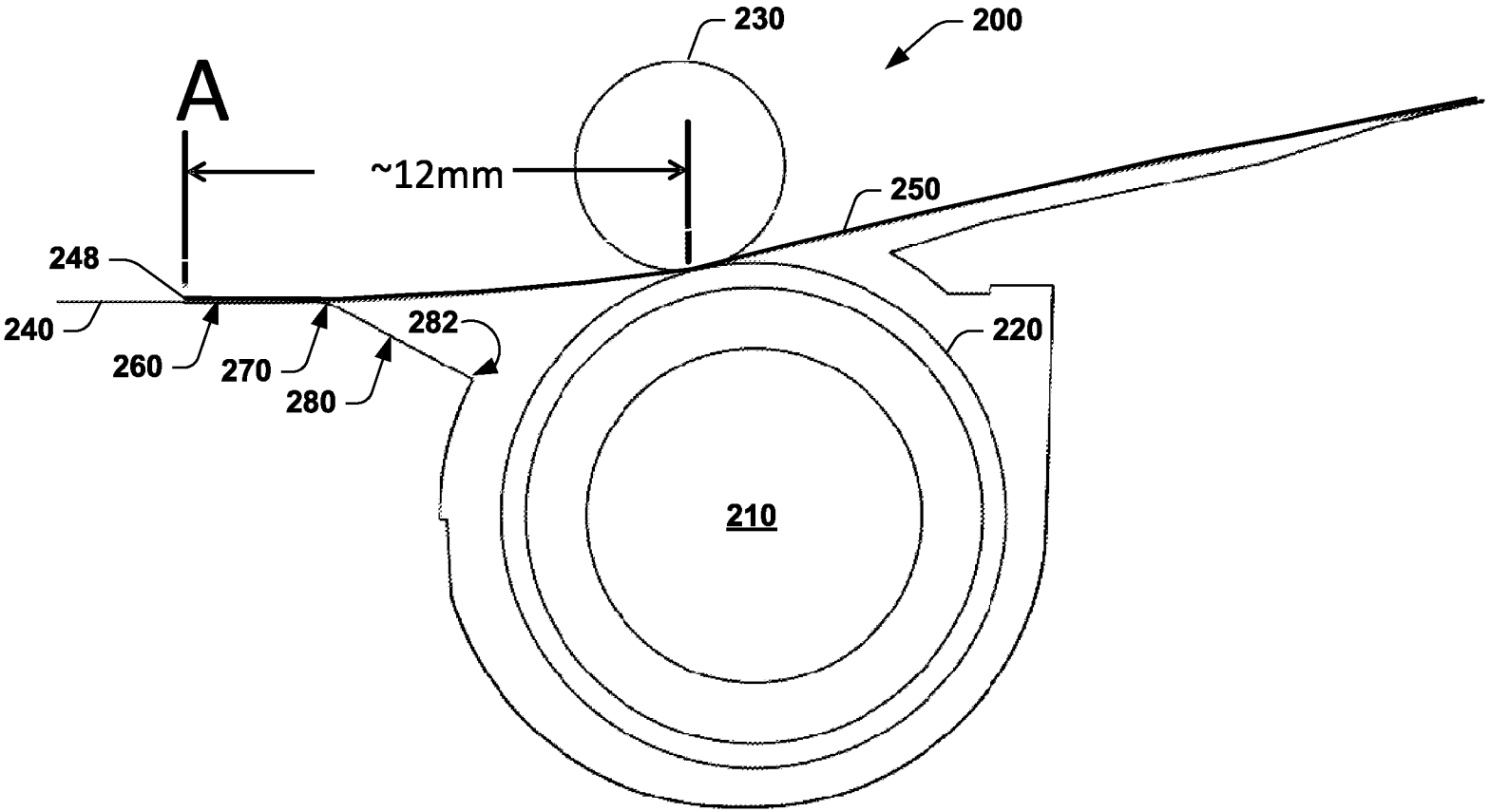
FIG. 2 illustrates an example of a feed system and media park location for mitigating roll curl in the media.

FIG. 2 illustrates an example of a feed system 200 and media park location for mitigating roll curl in the media. The system 200 shows an exploded view of a feed system of a printer. The system 200 utilizes the existing media path that includes a feedshaft, feedshaft pinch rollers 220 and 230, a platen 240, and media 250. Media motion control electronics (not shown) provide back bow on the media 250 to reduce the roll set curl. The media 250 can be fed out of the feedshaft pinch (feedshaft and pinch rollers) and onto the surface of the platen 240. The feedshaft pinch can be at a 12 degree angle relative to the surface of the platen to generate the feedshaft side reverse bow to mitigate curl.

The system 200 can employ about 12 degrees of reverse bow, in one example, to modify the curl of the leading edge 248 of the media 250 which is shown being parked at position 'A' on the platen 240. As noted previously, other park positions than the example of park position 'A' are possible, including multiple park points along the platen 240 before printing. As shown, the platen 240 can include a contact surface that includes distal and proximal portions 260 and 280, respectively. The distal surface 260 can be substantially planar and may include ribs (not shown). The distal surface portion 260 extends from a juncture 270 along a direction of media travel toward a print zone. The proximal surface portion 280 can extend from the juncture 270 at a predetermined angle below (as viewed in FIG. 2) the plane of the distal surface portion and terminate in a corresponding edge 282 thereof. Thus, the distal surface portion 260 can be connected via a juncture 270 to an angled proximal surface 280 to deflect the leading edge of the media 250. The proximal surface 280 of the platen 240 is typically angled to facilitate capture the leading edge of the media 250 as it is advanced off the roll via the rollers 220 and 230. While the proximal surface can in some examples be substantially planar, it may also be curved to provide a beveled edge for the platen. Additionally, the proximal surface 280 could also be a potential park location for engaging and holding the leading edge of the media 250, for example. In a standard printer, the leading edge 248 of the media 250 is held in space a few millimeters beyond the pinch point but not engaging the platen 240.

For the systems and methods described herein, the leading edge 248 of the media 250 can be advanced beyond the feedshaft nip and onto the platen ribs. When the media 250 is advanced to this position, the geometry imposes a bow (e.g., 12 degree bow) in the reverse direction to the roll curl and thus conditioning the leading edge of the media 250 to flatten. The effectiveness of mitigating curl can also be time dependent, thus, more curl can be removed the longer the leading edge of the media 250 is reverse bowed. As described previously, slowing the speed of travel of the leading edge 248 of the media 250 along the platen 240 can also correspond to a park position employed to mitigate roll curl.

Roll set curl is not a new challenge to roll based printers, however, the standard implementations in conventional systems have usually involved: adding mechanical complexity such as an index-able star wheel to hold the media down; vacuum media hold down; or lengthening the media path after the print zone to allow down-stream hardware to influence the media curl. Each of these implementations imposes additional constraints on the systems. Index-able star wheels require additional parts and a mechanism for activating the star wheels when required. Vacuum hold down requires a vacuum source, plumbing, air flow control, and dealing with the potential acoustic issues. Lengthening the media path requires an increase in the footprint of the product. All of these implementations require additional parts or material which leads to higher cost. The systems and methods described herein utilize existing printer hardware and thus do not add additional cost. This translates into a lower cost product with a potentially smaller footprint.

Figure 3:
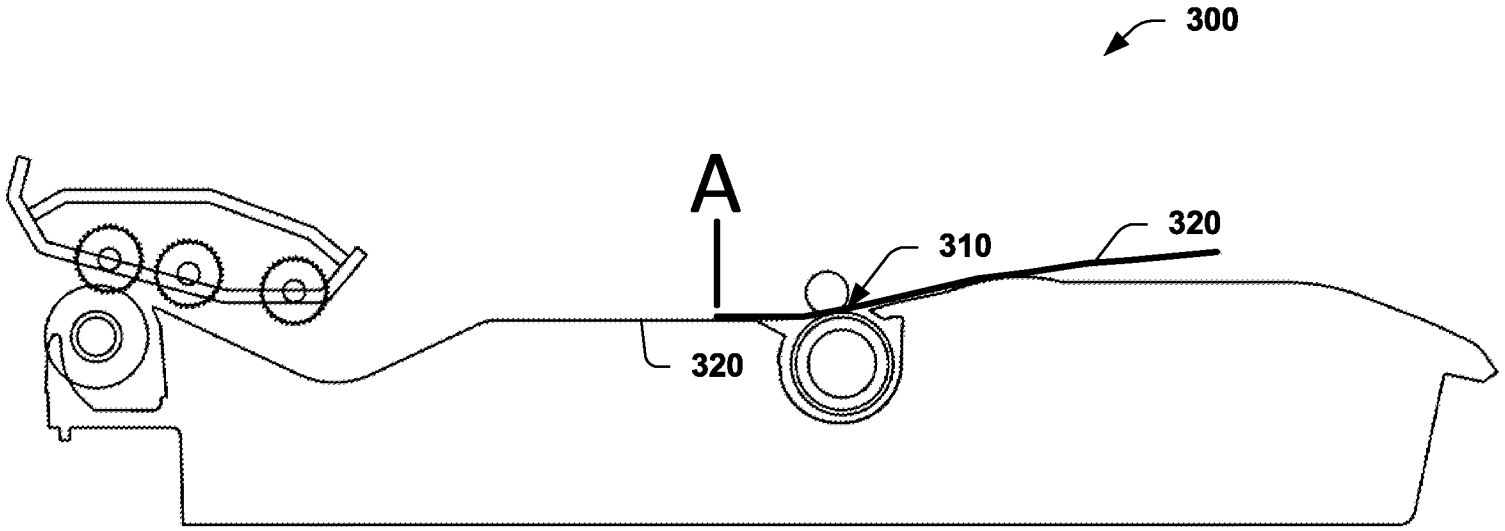
FIG. 3 illustrates an example of printer having a feed and media park location for mitigating roll curl in the media.

FIG. 3 illustrates an example of printer 300 having a feed 310 and media park location for mitigating roll curl in the media. As shown, media 320 is guided through the feed 310 to park location on a platen 330. As noted previously, it is possible to have multiple park locations along the platen 330 to mitigate curl in the media 320. Similarly, it is also possible to reduce the speed of the media 320 such that the reduced speed causes the media to arrive at the print zone as if the media had been parked at a fixed location for a predetermined time. Thus, in one example, the media 320 may be parked at position 'A' for 1 second before arriving at the downstream print zone at 1.5 seconds. In another example, the overall speed of travel of the media 320 can be reduced such that the leading edge of the media arrives at the print zone in 1.5 seconds in this example. Therefore, the holding time for both the fixed park location and the reduced speed scenario can be controlled to be about the same. As shown, an output assembly 340 of rollers and gears can guide the media 320 from the printer 300.

Figure 4:
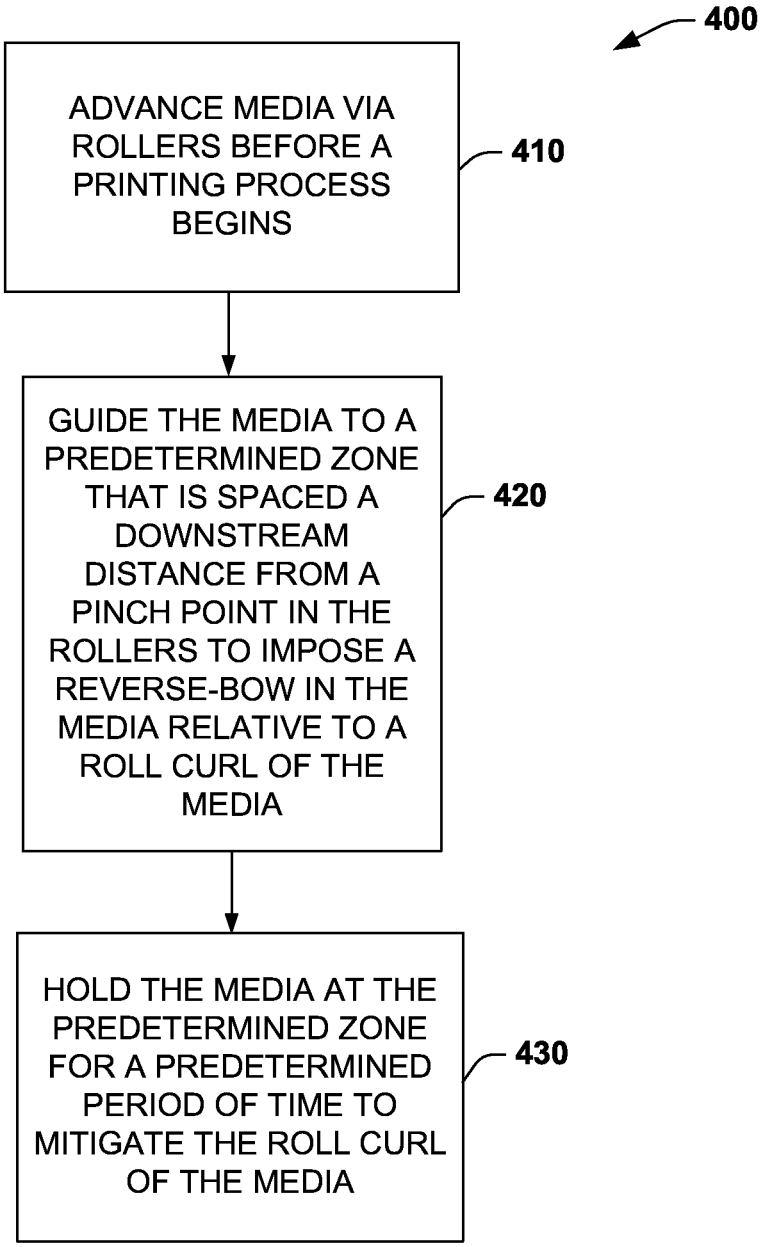
FIG. 4 illustrates an example method for mitigating roll curl in media.

In view of the foregoing structural and functional features described above, an example method will be better appreciated with reference to FIG. 4. While, for purposes of simplicity of explanation, the method is shown and described as executing serially, it is to be understood and appreciated that the method is not limited by the illustrated order, as parts of the method could occur in different orders and/or concurrently from that shown and described herein.

FIG. 4 illustrates an example method 400 for mitigating roll curl in media. At 410, the method 400 includes advancing media via rollers before a printing process begins (e.g., via controller 110 and feed 148 of FIG. 1). At 420, the method 400 includes guiding the media to a predetermined zone that is spaced a downstream distance from a pinch point in the rollers to impose a reverse-bow in the media relative to a roll curl of the media (e.g., via controller 110 and park control module 120 of FIG. 1). At 430, the method 400 includes holding the media at the predetermined zone for a predetermined period of time to mitigate the roll curl of the media (e.g., via controller 110 and park control module 120 of FIG. 1). The holding the media can also include holding the media at multiple locations from the pinch point to mitigate the roll curl in the media.

Figure 5:
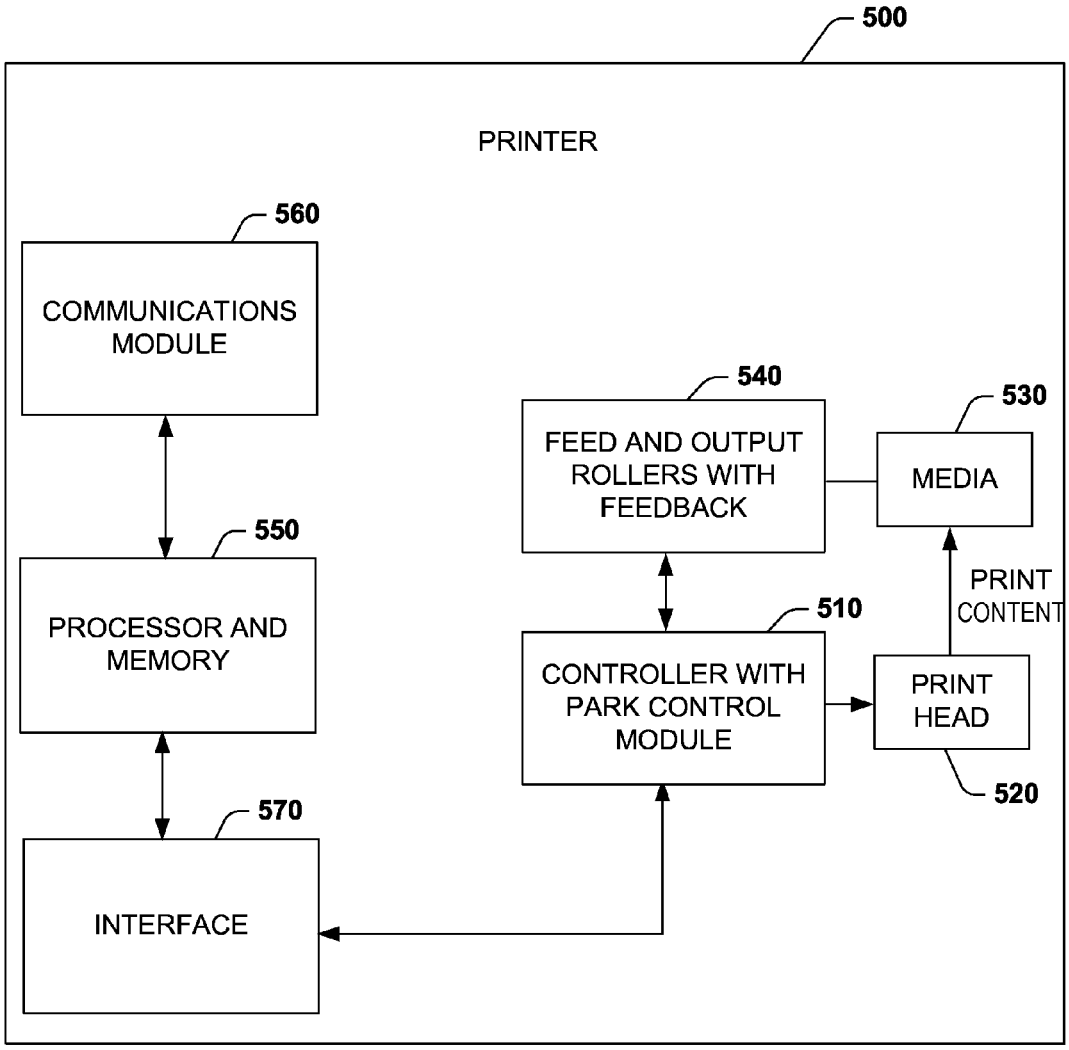
FIG. 5 illustrates an example printer that employs a controller and park control module to mitigate roll curl in media.

FIG. 5 illustrates an example printer 500 that employs a controller and park control module 510 to mitigate roll curl in media. The printer 500 includes a print head 520 to apply printed content onto media 530. For example, the print head can dispense ink on to the media 530 to print the content that is represented as content data. The controller 510 commands the print head 520 to dispense the ink on the media 530. A feed roller receives the media 530 and an output roller ejects the media is shown at 540, wherein the controller 510 controls the feed roller and the output roller to adjust the speed and direction of the media 530. The park control module in the controller 510 commands the controller to adjust the speed or direction of the media to direct the media toward a surface such as a platen in the printer 500 to mitigate curl in the media 530. A processor and memory module 550 can direct remote print commands to the controller 510. The park control module can command the controller 510 to perform multiple holds of the media 530 through the feed roller to mitigate curl in the media as it is held on the surface of the platen. Also, the park control module in the controller 510 can adjust a delay so that the media remains in the feed roller to mitigate curl in the media.

The printer 500 can also include a communications module 560 for receiving print commands and updating printer status. The communications module 560 can include local connections such as from a print cable and/or can include remote network connections such as can be received from a local network and/or over a public network such as the Internet, for example. The communications module 560 can be operated by the processor and memory module 560 which can include executable operating instructions to operate the printer 500. Such instructions can operate the method 400 described above with respect to FIG. 4, for example. The processor and memory module 550 can also connect to an interface module 570 that performs interface operations to the controller 510 such as providing different print commands to the controller such as print, hold, retract, form feed, font commands, color commands, or other formatting commands, for example.

What have been described above are examples. It is, of course, not possible to describe every conceivable combination of components or methodologies, but one of ordinary skill in the art will recognize that many further combinations and permutations are possible. Accordingly, the disclosure is intended to embrace all such alterations, modifications, and variations that fall within the scope of this application, including the appended claims. As used herein, the term "includes" means includes but not limited to, the term "including" means including but not limited to. The term "based on" means based at least in part on. Additionally, where the disclosure or claims recite "a," "an," "a first," or "another" element, or the equivalent thereof, it should be interpreted to include one or more than one such element, neither requiring nor excluding two or more such elements.

What is claimed is:

1. A method comprising:

adjusting, by a controller device comprising a processing resource integrated within a printer, a downstream distance between a roller pinch point and a predetermined zone;

advancing, by the controller device, a media from a roll into the printer via rollers before a printing process begins, wherein a leading edge of the media comprises a curl due to the roll;

guiding, by the controller device, the media through the printer to engage a platen in the predetermined zone; and holding, by the controller device triggered based on a signal from a park control module indicating a detection of the leading edge of the media engaging the platen, the media against a contact surface of the platen in the predetermined zone to force the leading edge of the media to be flexed in a direction opposite the curl of the leading edge to counteract the curl of the leading edge, wherein the holding further comprises physically stopping the media against the contact surface of the platen in the predetermined zone for a predetermined period of time.

2. The method of claim 1, wherein the guiding further comprises:

guiding the media past the predetermined zone; and reversing the media to the predetermined zone to be held against the contact surface of the platen.

3. The method of claim 1, wherein the predetermined period of time is adjustable by the controller device.

4. The method of claim 1, wherein the holding further comprises reducing a speed of the media as it advances over the platen in the predetermined zone.

5. The method of claim 1, wherein the holding further comprises holding the media at multiple locations against the platen in the predetermined zone to counteract the curl.

6. The method of claim 1, wherein a speed of the advancement of the media over the predetermined zone is adjustable by the controller device.

7. A printer, comprising:

a controller, comprising a processing resource, to adjust a speed and a direction of a media advancing from a roll into the printer via rollers before a printing process begins, wherein a leading edge of the media comprises a curl due to the roll; and a park control module to command the controller to guide the leading edge of the media through the printer to engage a platen in a predetermined zone spaced downstream a predetermined distance from a roller pinch point and to physically stop the media against a contact surface of the platen in the predetermined zone for a predetermined period of time to force the leading edge of the media to bend in a direction opposite the curl of the leading edge to counteract the curl of the leading edge.

8. The printer of claim 7, wherein the park control module commands the controller to hold the leading edge of the media for a predetermined time on a surface of the platen at a distance of about 12 millimeters past the roller pinch point.

9. The printer of claim 7, wherein a pinch angle in the printer is at about 12 degrees to create a reverse-bow in the leading edge of the media as it engages a surface of the platen to counteract the curl of the leading edge.

10. The printer of claim 7, wherein the park control module commands the controller to reduce the speed of travel of the leading edge of the media over the platen to emulate a stationary park position.

11. The printer of claim 7, wherein the park control module commands the controller to stop the travel of the leading edge of the media over the platen to hold the leading edge of the media.

12. The printer of claim 7, wherein the controller is configured to receive an input setting the speed of advancement of the media.

* * * * *